US006702499B1

(12) United States Patent
Fang

(10) Patent No.: US 6,702,499 B1
(45) Date of Patent: Mar. 9, 2004

(54) PEN CAP

(76) Inventor: Te Hsiang Fang, No. 130, Lung Ping Road, San Chung City, Taipei Hsien (TW)

( * ) Notice: Subject to any disclaimer, the term of this patent is extended or adjusted under 35 U.S.C. 154(b) by 0 days.

(21) Appl. No.: 10/396,254

(22) Filed: Mar. 25, 2003

(30) Foreign Application Priority Data

Mar. 5, 2003 (TW) ..... 092203303

(51) Int. Cl.[7] ..... B43K 23/12; B43K 29/00

(52) U.S. Cl. ..... 401/243; 401/195; 401/194; 362/118

(58) Field of Search ..... 401/243, 195, 401/194, 202; 362/118

(56) References Cited

U.S. PATENT DOCUMENTS 4,518,274 A * 5/1985 Hanggi ..... 401/195
5,845,985 A * 12/1998 Xiong et al. ..... 362/118
5,988,832 A * 11/1999 Chen ..... 362/259

* cited by examiner

*Primary Examiner*—David J. Walczak
(74) *Attorney, Agent, or Firm*—Nelson A. Quintero

(57) ABSTRACT

A pen cap is constructed to include a cap body with a clip, a lighting circuit assembly, the lighting circuit assembly including a battery set mounted inside the cap body, an IC chip mounted on the clip and electrically connected to the battery set through a switch at the top of the cap body, and LED chips of different colors electrically connected to the IC chip, and a show plate fixedly mounted on the IC chip to hold the LED chips, the show plate having a design surrounded by the LED chips.

10 Claims, 2 Drawing Sheets

PEN CAP

BACKGROUND OF THE INVENTION

1. Field of the Invention

The present invention relates to a pen cap for capping a pen and, more particularly, to such a pen cap, which has a show plate for showing a design, and a lighting circuit for producing a lighting effect to attract people's attention.

2. Description of the Related Art

A regular pen may be equipped with a cap that protects the writing element of the pen. The cap of a pen may have a clip for fastening. Further, a pen may be used as a gift in business. A pen for this purpose usually carries a logo or advertising matter. However, the still logo or advertising matter does not attract people's attention.

SUMMARY OF THE INVENTION

The present invention has been accomplished under the circumstances in view. It is the main object of the present invention to provide a pen cap, which has means for showing a design. It is another object of the present invention to provide a pen cap, which has lighting means to attract people's attention. To achieve these and other objects of the present invention, the pen cap comprises a pen body, the pen body comprising a battery chamber, and a clip on the outside; a lighting circuit, the lighting circuit comprising a battery set mounted inside the battery chamber of the pen body, an IC chip fixedly mounted on the clip, a positive pole electrode and a negative pole electrode respectively extended from the IC chip and adapted to contact positive and negative terminals of the battery set respectively, and a plurality of LED (light emitting diode) chips respectively electrically connected to the IC chip and controlled by the IC chip to emit light; switch means mounted on the cap body and adapted to switch on/off the lighting circuit; and a show plate fixedly mounted on the IC chip and adapted to accommodate the LED chips, the show plate having a design.

DETAILED DESCRIPTION OF THE PREFERRED EMBODIMENT

Figure 1:
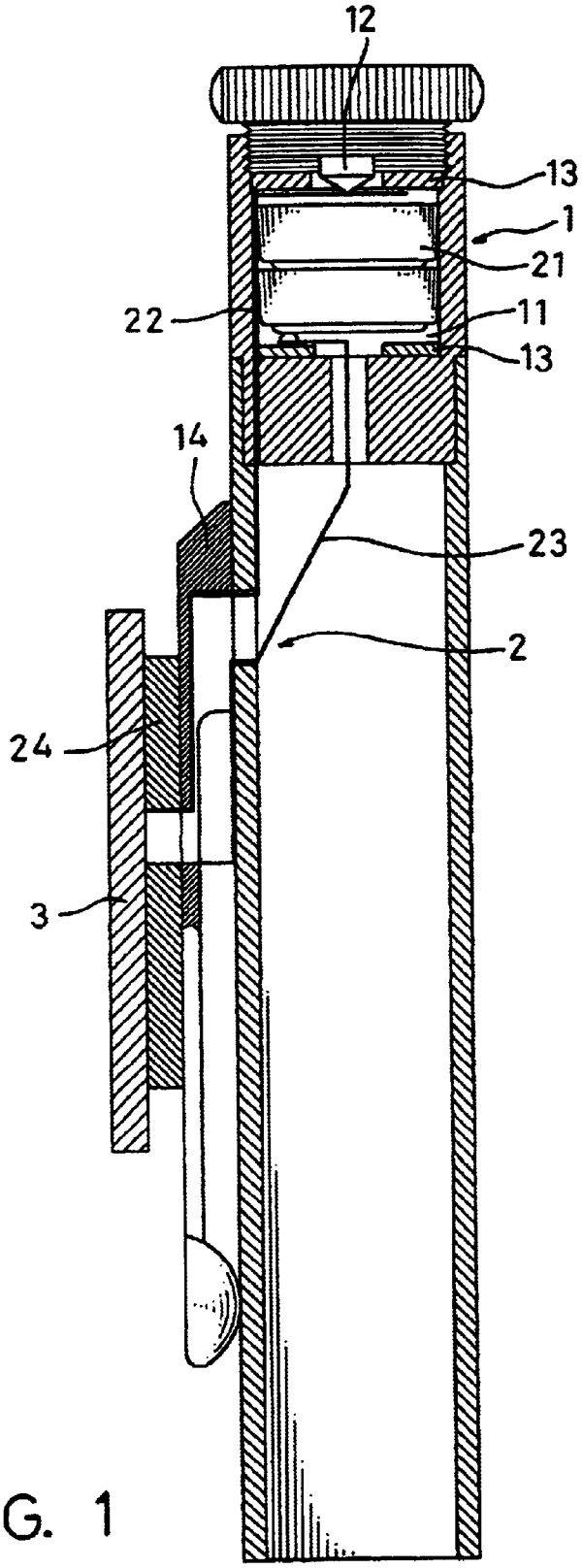
FIG. 1 is a sectional assembly view of a pen cap according to the present invention.
Figure 2:
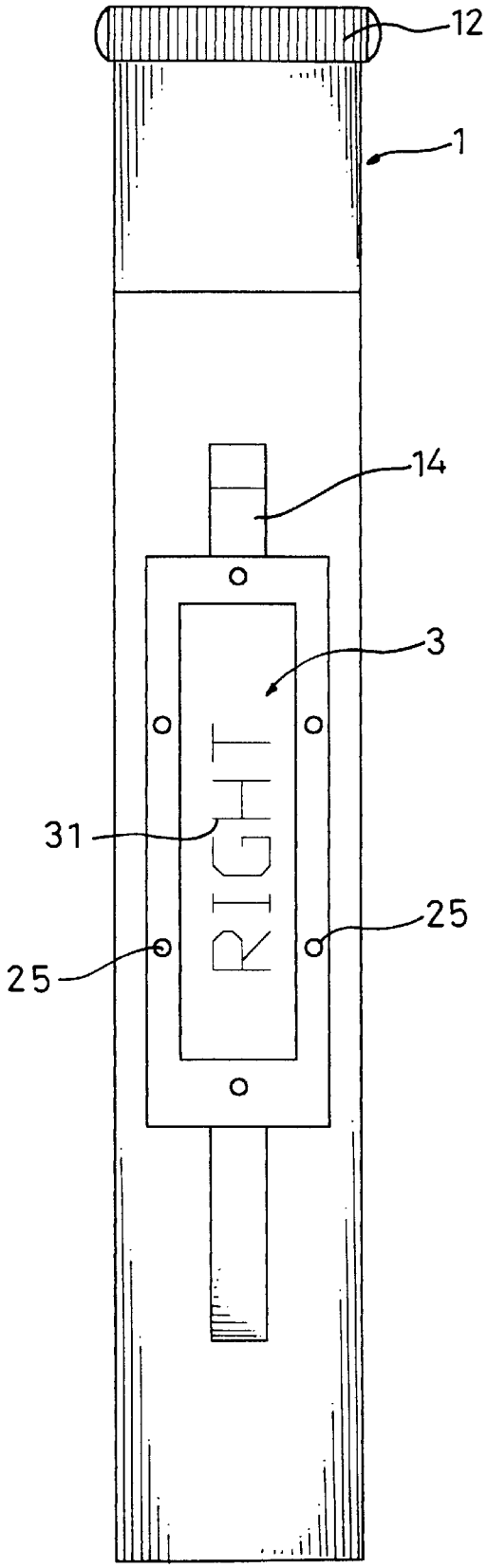
FIG. 2 is a front view of the pen cap according to the present invention.

Referring to FIGS. 1 and 2, a pen cap is shown comprising a cap body 1, a lighting circuit assembly 2, and a show plate 3.

The cap body 1 is to be capped on a pen (not shown) to protect the writing element of the pen, having a battery chamber 11, two flexible annular cushions 13 mounted in the top and bottom sides of the battery chamber 11, a top rotary switch 12 threaded into a top side of said cap body, and a clip 14 located on the outside for fastening. In one embodiment of the invention, the battery chamber is an independent member detachably fastened to said cap body. The lighting circuit assembly 2 comprises a battery set 21 mounted in the battery chamber 11 between the flexible annular cushions 13, an IC chip 24 fixedly fastened to the clip 14, a positive pole electrode 22 and a negative pole electrode 23 respectively extended from the IC (integrated circuit) chip 24 and adapted to contact the positive terminal and negative terminal of the battery set 21, and a plurality of LED (light emitting diode) chips 25 respectively installed in the show plate 3 and electrically connected to the IC chip 24. The LED chips 25 can be of different colors. The show plate 3 is fixedly mounted on the IC chip 24, having a design 31 in it. The show plate 3 can be made having any of a variety of shapes. According to this embodiment, the show plate 3 is shaped like a rectangular frame. The design 31 can be a brand designation, a logo, a product label, or a statement. Further, the design 31 can be a sheet member, for example a sticker, which is adhered to the show plate 3. Alternately, the design 31 can be directly printed on the show plate 3.

Referring to FIGS. 1 and 2 again, when rotating the rotary switch 12 in one direction, the circuit of the battery set 21, the electrodes 22 and 23, the IC chip 24 and the LED chips 25 are closed, thereby causing the LED chips 25 to emit light or to flash subject to the circuit design of the IC chip 24. On the contrary, when rotating the rotary switch 12 in the reversed direction, the circuit is opened, and the LED chips 25 are off.

A prototype of pen cap has been constructed with the features of FIGS. 1 and 2. The pen cap functions smoothly to provide all of the features discussed earlier.

Although a particular embodiment of the invention has been described in detail for purposes of illustration, various modifications and enhancements may be made without departing from the spirit and scope of the invention. For example, an independent battery case can be provided and detachably fastened to the cap body to hold the battery set. Accordingly, the invention is not to be limited except as by the appended claims.

What the invention claimed is:

1. A pen cap comprising:

a cap body, said cap body comprising a battery chamber, and a clip on the outside;

a lighting circuit, said lighting circuit comprising a battery set mounted inside said battery chamber of said cap body, an IC chip fixedly mounted on said clip, a positive pole electrode and a negative pole electrode respectively extended from said IC chip and adapted to contact positive and negative terminals of said battery set respectively, and a plurality of LED chips respectively electrically connected to said IC chip and controlled by said IC chip to emit light;

switch means mounted on said cap body and adapted to switch on/off said lighting circuit; and a show plate fixedly mounted on said IC chip and adapted to accommodate said LED chips, said show plate having a design.

2. The pen cap as claimed in claim 1, wherein said switch means is a rotary switch threaded into a top side of said cap body.

3. The pen cap as claimed in claim 1, wherein said cap body comprises two annular cushions mounted inside said battery chambers at different elevations and adapted to support said battery in said battery chamber.

4. The pen cap as claimed in claim 1, wherein said battery chamber is an independent member detachably fastened to said cap body.

5. The pen cap as claimed in claim 1, wherein said IC chip controls said LED chips to flash when switched on by said switch means.

6. The pen cap as claimed in claim 1, wherein said LED chips are of different colors.

7. The pen cap as claimed in claim 1, wherein said design is a combination of a pattern and a statement.

8. The pen cap as claimed in claim 1, wherein said show plate has a geometric shape.

9. The pen cap as claimed in claim 1, wherein said LED chips are mounted in said show plate around said design.

10. The pen cap as claimed in claim 1, wherein said design is a sheet member adhered to said show plate.

* * * * *